US011609049B2

(12) United States Patent
Greiciunas

(10) Patent No.: US 11,609,049 B2
(45) Date of Patent: Mar. 21, 2023

(54) HEAT EXCHANGER

(71) Applicant: BAE Systems plc, London (GB)

(72) Inventor: Evaldas Greiciunas, Leeds (GB)

(73) Assignee: BAE Systems plc, London (GB)

( * ) Notice: Subject to any disclaimer, the term of this patent is extended or adjusted under 35 U.S.C. 154(b) by 356 days.

(21) Appl. No.: 16/976,309

(22) PCT Filed: Mar. 8, 2019

(86) PCT No.: PCT/GB2019/050654
§ 371 (c)(1),
(2) Date: Aug. 27, 2020

(87) PCT Pub. No.: WO2019/171078
PCT Pub. Date: Sep. 12, 2019

(65) Prior Publication Data

US 2021/0055064 A1 Feb. 25, 2021

(30) Foreign Application Priority Data

| | | |
|---|---|---|
| Mar. 9, 2018 | (EP) | 18160944 |
| Mar. 9, 2018 | (GB) | 1803780 |
| Aug. 30, 2018 | (GB) | 1814115 |

(51) Int. Cl.
*F28F 3/08* (2006.01)
*F28D 9/00* (2006.01)

(52) U.S. Cl.
CPC ..... *F28F 3/086* (2013.01); *F28D 9/0093* (2013.01)

(58) Field of Classification Search
CPC ..... F28F 3/086; F28F 7/02; F28F 3/12; F28D 9/0093; F28D 9/0043; F28D 9/005; F28D 9/0056; F28D 9/0075
USPC ..... 165/167
See application file for complete search history.

(56) References Cited

U.S. PATENT DOCUMENTS

| | | | | |
|---|---|---|---|---|
| 9,777,973 | B2 * | 10/2017 | Heusser | B01F 25/43161 |
| 10,422,585 | B2 * | 9/2019 | Jensen | F28D 7/1615 |
| 2002/0084059 | A1 | 7/2002 | Rittberger | |
| 2009/0101313 | A1 * | 4/2009 | Hofmann | F28F 3/12 165/104.19 |

(Continued)

FOREIGN PATENT DOCUMENTS

| | | | |
|---|---|---|---|
| CN | 101479032 | A | 7/2009 |
| CN | 104389683 | A | 3/2015 |

(Continued)

OTHER PUBLICATIONS

Search Report for Great Britain Patent Appl. No. 1803780.4, dated Aug. 13, 2018, 4 Pages.

(Continued)

*Primary Examiner* — Justin M Jonaitis
(74) *Attorney, Agent, or Firm* — Maine Cernota & Rardin

(57) ABSTRACT

There is disclosed a heat exchanger comprising: a plurality of first fluid channels, a plurality of conduits for interconnecting the first fluid channels, a plurality of second fluid channels, a plurality of conduits for interconnecting the second fluid channels, wherein the heat exchanger is configured as a plurality of repeating units, each repeating unit comprising: a base plate comprising a first opening, and a first conduit extending from the plate, the shape of the opening corresponding to the shape of the conduit.

19 Claims, 6 Drawing Sheets

(56) References Cited

U.S. PATENT DOCUMENTS

| | | | | |
|---|---|---|---|---|
| 2009/0126911 | A1 | 5/2009 | Shore et al. | |
| 2010/0139900 | A1 | 6/2010 | Thompson | |
| 2015/0027669 | A1 * | 1/2015 | Kokas | F28F 3/12 165/104.26 |

FOREIGN PATENT DOCUMENTS

| | | | | |
|---|---|---|---|---|
| EP | 1160530 | A1 | 5/2001 | |
| EP | 1548387 | A1 | 6/2005 | |
| EP | 3150952 | A1 | 4/2017 | |
| GB | 1506721 | A * | 4/1978 | B01D 25/12 |
| GB | 1506721 | A | 4/1978 | |
| JP | 2010270982 | A | 12/2010 | |
| JP | 2017048961 | A | 3/2017 | |
| WO | 2008139651 | A1 | 11/2008 | |
| WO | 2011068470 | A1 | 6/2011 | |

OTHER PUBLICATIONS

Office Action for U.S. Appl. No. 16/976,366 dated Oct. 29, 2021, 17 Pages.
International Search Report and Written Opinion for Patent Appl. No. PCT/GB2019/050653, dated May 6, 2019, 7 Pages.
European Search Report for Patent Appl. No. 18160938.9, dated Aug. 6, 2018, 6 Pages.
Search Report for Great Britain Patent Appl. No. 1803776.2, dated Aug. 10, 2018, 4 Pages.
International Search Report and Written Opinion for Patent Appl. No. PCT/GB2019/050654, dated May 8, 2019, 8 Pages.
Search Report for European Patent Appl. No. 18160944.7, dated Jul. 18, 2018, 6 Pages.
Search Report for Great Britain Patent Appl. No. 1803780.4, dated Aug. 10, 2020, 4 Pages.
International Search Report and Written Opinion for PCT Patent Appl. No. PCT/GB2019/050654, dated May 8, 2019, 11 Pages.
International Search Report for PCT Patent Appl. No. PCT/GB2019/050655, dated May 15, 2019, 12 Pages.
Search Report for Great Britain Patent Appl. No. 1814115.0, dated Feb. 15, 2019, 5 Pages.
International Preliminary Report on Patentability for PCT Patent Appl. No. PCT/GB2019/050653, dated Sep. 15, 2020, 7 Pages.
International Preliminary Report on Patentability for PCT Patent Appl. No. PCT/GB2019/050654, dated Sep. 15, 2020, 7 Pages.
International Preliminary Report on Patentability for PCT Patent Appl. No. PCT/GB2019/050655, dated Sep. 15, 2020, 7 Pages.
Notice of Allowance for U.S. Appl. No. 16/976,366 dated Dec. 8, 2021, 5 Pages.
Office Action for U.S. Appl. No. 16/976,217 dated Oct. 5, 2022, 28 pages.
Search Report by Registered Search Organization for Patent Appl. No JP2020570653 dated Oct. 13, 2021, 17 pages.
Notice of Reasons for Refusal for Patent Appl. No. JP2020570653 dated Oct. 13, 2021, 13 pages.
European Office Action for Patent Appl. No. EP19709556.5 dated Dec. 7, 2021, 5 pages.
Examination Report for Patent Appl. No. GB1803776.2 dated Jan. 13, 2022, 2 pages.
Examination Report for Patent Appl. No. GB1803780.4 dated Jan. 13, 2022, 1 page.
European Office Action for Patent Appl. No. EP19709557.3 dated Feb. 3, 2022, 5 pages.
European Office Action for Patent Appl. No. EP19711687.4 dated Feb. 7, 2022, 5 pages.
Examination Report for Patent Appl. No. GB1814115.0 dated Feb. 10, 2022, 3 pages.
Examination Report for Patent Appl. No. GB1814115.0 dated May 30, 2022, 1 page.

* cited by examiner

HEAT EXCHANGER

RELATED APPLICATIONS

This application is a national phase application filed under 35 USC §371 of PCT Application No. PCT/GB2019/050654 with an International filing date of Mar. 8, 2019, which claims priority of GB Patent Application 1803780.4 filed on Mar. 9, 2018, EP Patent Application 18160944.7 filed on Mar. 9, 2018, and GB Patent Application 1814115.0 filed on Aug. 30, 2018. Each of these applications is herein incorporated by reference in its entirety for all purposes.

FIELD

According to the present invention there is provided a heat exchanger.

BACKGROUND

It is known, for example from WO2014/135844 (BAE Systems plc), to provide a heat exchanger with a plurality of channels for a working fluid, these channels being interleaved amongst a plurality of channels for coolant fluid.

It is also known to introduce baffles into channels to affect flow and heat transfer. Baffles can improve the heat transfer efficiency of a heat exchanger, but can tend to raise the pressure drop across the exchanger.

SUMMARY

According to a first aspect of the invention there is provided a heat exchanger comprising: a plurality of first fluid channels, a plurality of conduits for interconnecting the first fluid channels, a plurality of second fluid channels, a plurality of conduits for interconnecting the second fluid channels, wherein the heat exchanger is configured as a plurality of repeating units, each repeating unit comprising: a base plate comprising a first opening, and a first conduit extending from the plate, the shape of the opening corresponding to the shape of the conduit.

Such heat exchangers can readily be formed from a template of input data, and are suited to forming by various manufacturing techniques, additive layer manufacturing methods in particular. They can also offer increased inter channel mixing, which can tend to raise the heat transfer capability.

The plurality of repeating units may be arranged as a matrix, where units repeat in a first and second mutually orthogonal direction, and each repeating unit is contiguous with neighbouring units in the plane defined by the first and second mutually orthogonal direction, such that base plates in the plane are coplanar.

Units in the matrix may further repeat in a third direction mutually orthogonal to the first and second directions, where each repeating unit is contiguous with neighbouring units such that the conduit from a first neighbouring unit connects to the first opening and the conduit connects to an opening of a second neighbouring unit.

The conduit may be substantially straight and substantially perpendicular to the base plate.

Such a provision gives a generally simple structure.

The conduit may be inclined to the base plate and may terminate in a space perpendicularly above the opening.

Providing inclined conduits can tend to reduce the pressure drop across the heat exchanger, for a given channel mixing characteristic.

The conduit may have an elongate cross sectional form. The elongate cross-sectional form may define a shorter aspect S and a longer aspect L wherein the longer aspect L is substantially aligned with a predetermined flow direction. Additionally or alternatively, the longer aspect L may be substantially aligned with the incline of the conduit.

The base plate may have a further opening and a further conduit.

The opening, conduit, further opening and further conduit, may have rotational symmetry substantially about an axis extending perpendicularly from the base plate.

The base plate may have a tessellating form, and for example may be rectangular.

According to a second aspect of the invention, there is provided a method of forming a heat exchanger structure for a heat exchanger having a plurality of first fluid channels and a plurality of second fluid channels, the first fluid channels comprising a plurality of interconnecting conduits, the second fluid channels comprising a plurality of interconnecting conduits, the method comprising: defining a repeating unit; defining a space available for a heat exchanger structure; determining how many repeating units would combine to occupy the space available, forming a plurality of the repeating units and thereby forming the heat exchanger structure.

Such a method can give an engineer an adaptable process for simply designing a bespoke heat exchanger to match a particular set of environments and requirements, chosen from a number of different environments and requirements.

The repeating unit may be predetermined as being in the form of a base plate comprising a first opening, and a first conduit extending from the plate, the shape of the opening corresponding to the shape of the conduit.

Defining the repeating unit may comprise determining a base plate depth, a conduit inner and outer diameter, and an extension height.

The method may further comprise further forming: a housing for the heat exchanger structure, a first manifold comprising, a first fluid ingress manifold comprising an input port which splits into a plurality of input branches, each branch corresponding with a first fluid channel, a second fluid egress manifold comprising an outlet port which convenes a plurality of outlet branches, each branch corresponding with a second fluid channel, an second manifold comprising: a first fluid egress manifold comprising an outlet port which convenes a plurality of outlet branches, each branch corresponding with a first fluid channel; a second fluid ingress manifold comprising an input port which splits into a plurality of input branches, each branch corresponding with a second fluid channel, to thereby form a heat exchanger.

The first and second manifolds may each formed as a monolithic structure, the inlet branches and outlet branches being in an interdigitated arrangement.

The heat exchanger structure, the housing and the manifolds may be formed in a single additive layer manufacturing process.

BRIEF DESCRIPTION OF THE DRAWINGS

So that the invention may be well understood, exemplary embodiments are herein described with reference to the following figures, of which.

DETAILED DESCRIPTION

It will be appreciated that relative terms such as horizontal and vertical, top and bottom, above and below, left and right, front/fore and back/aft, near and far, and so on, are used below merely for ease of reference to the Figures, and these terms are not limiting as such, and any two differing directions or positions and so on may be implemented rather than truly horizontal and vertical, top and bottom, and so on.

Figure 1:
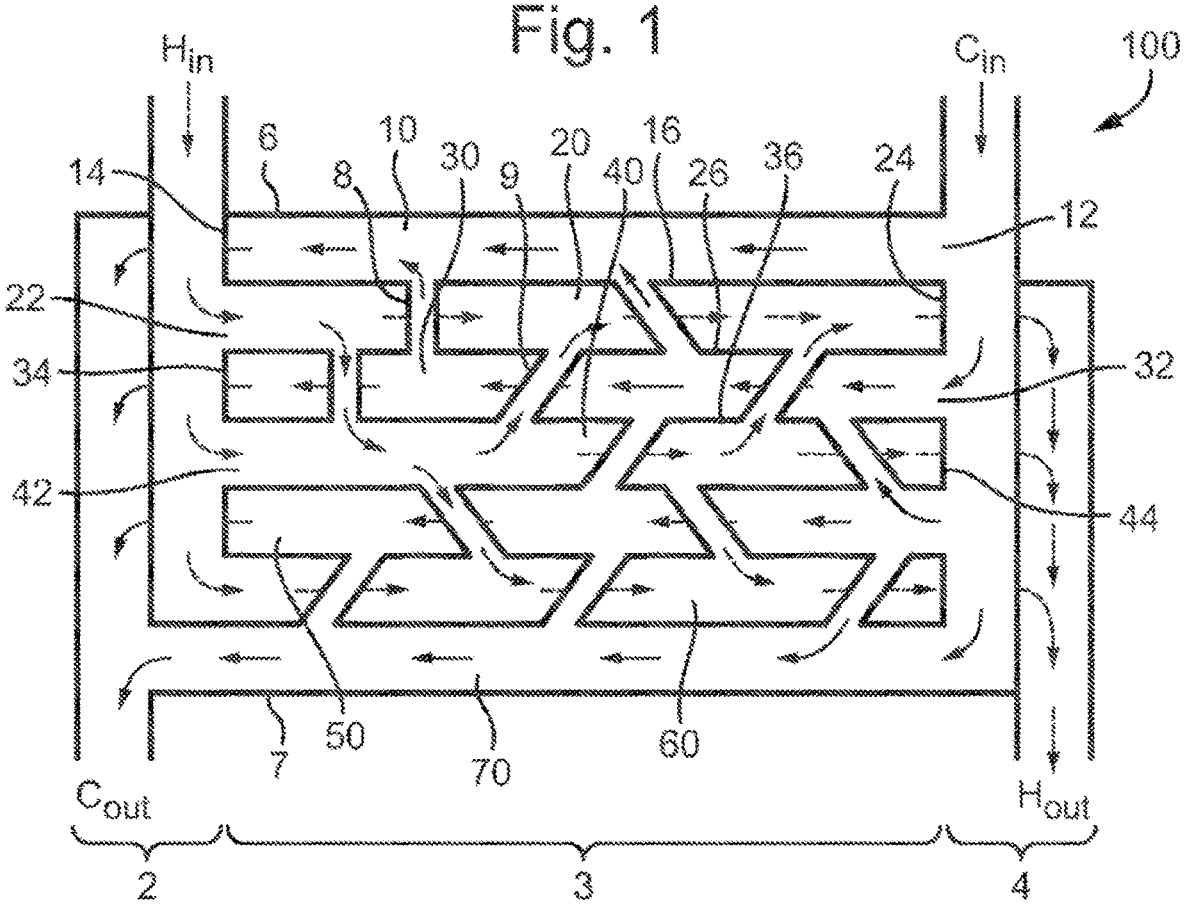
FIG. 1 shows a schematic cross-section of a first example heat exchanger.
Figure 5:
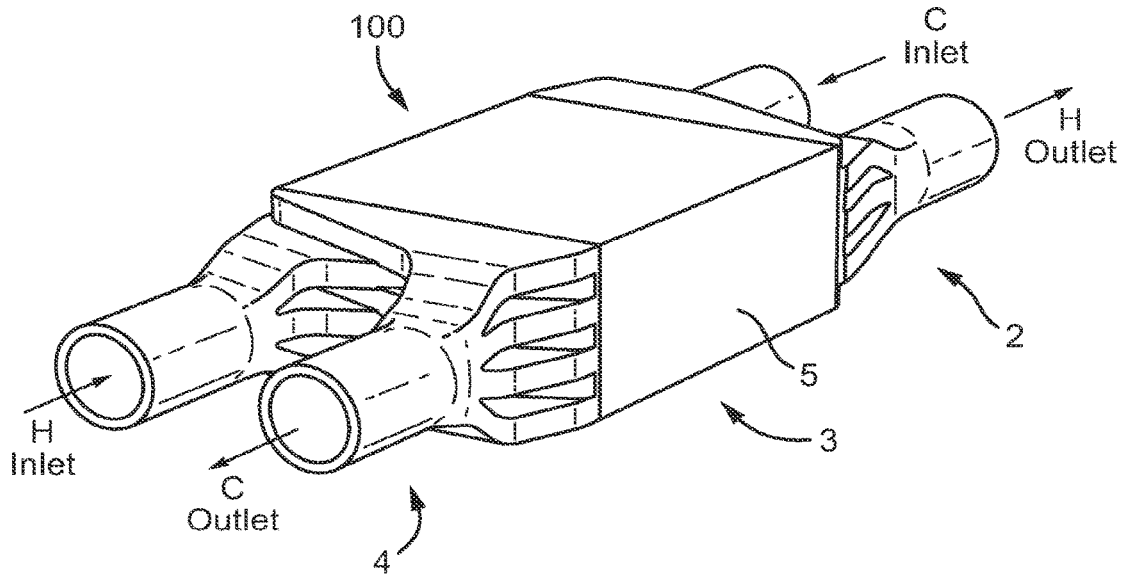
FIG. 5 shows a three-dimensional representation of a the first example heat exchanger.

With reference to FIGS. 1 and 5, a first heat exchanger is shown generally at 100 which comprises a first manifold 2, a core 3, and a second manifold 4.

The heat exchanger 100 is arranged for counter-flow where a first fluid, hot fluid H (which may alternatively be referred to as a working fluid), passes in the opposite direction to a second fluid, cold fluid C (which may alternatively be referred to as a coolant fluid). As shown in FIG. 1, the hot fluid H passes through the core from right-to-left, whilst the cold fluid C passes through the core left-to-right.

In alternative heat exchangers contemplated, the hot fluid H and the cold fluid C could be arranged for co-flow (where the fluids run in the same direction, e.g. both right-to-left) or cross-flow (where fluids run perpendicular to each other).

The core 3 comprises a plurality of channels. These channels are configured as two groups, the first group for transporting the first fluid, the second group for transporting the second fluid. Channels alternate by group so that an interleaved arrangement is provided, with channels separated by base plates. A multi-layer stack is thus provided. The first group of channels, corresponding with the odd-numbered channels pass fluid in a first direction. The second group of channels, corresponding with the even-numbered channels, pass the fluid in a second direction.

In particular, a first channel 10 is defined between a top plate 6 and a first base plate 16, and extends between a pair of first channel ports. These ports are configured for a right-to-left (as shown in FIG. 1) flow direction and as such represent a first inlet 12 communicating with the second manifold 4 and a first outlet 14 communicating with the first manifold 2.

A second channel 20 is defined between the first base plate 16 and a second base plate 26, and extends between a pair of second channel ports. These ports are configured for a left-to-right (as shown in FIG. 1) flow direction and as such represent a second inlet 22 communicating with the first manifold 2 and a second outlet 24 communicating with the second manifold 4.

A third channel 30 is defined between the second base plate 26 and a third base plate 36, and extends between a pair of third channel ports. These ports are configured for a right-to-left (as shown in FIG. 1) flow direction and as such represent a third inlet 32 communicating with the second manifold 4 and a third outlet 34 communicating with the first manifold 2.

A fourth channel 40 is defined between the third base plate 36 and the fourth base plate 46, and extends between a pair of fourth channel ports. These ports are configured for to a left-to-right (as shown in FIG. 1) flow direction and as such represent a fourth inlet 42 communicating with the first manifold 2 and a fourth outlet 44 communicating with the second manifold 4.

Further, there is equivalently provided: a fifth, sixth and seventh channel (50, 60 and 70 respectively); a fifth and sixth base plate (not numbered so as to reduce visual clutter in the figure), and a bottom plate 7, and their respective inlets and outlets (not numbered).

With additional reference to FIG. 5, the channels are further defined by side walls 5.

Thus a first group of channels, the odd channels, comprises the first, third, fourth, fifth and seventh channels. These odd channels can pass a common fluid in a common direction, in this example they pass hot fluid H right to left. In other examples they could pass fluid left to right.

A second group of channels, the even channels, comprises the second, fourth and sixth channels. These even channels can pass a common fluid in a common direction, in this example they pass a cold fluid C from left to right. In other examples they could pass fluid right to left.

Thus in the core 3 there are four channels in the first group and three channels in the second group. Providing an unequal number of channels in an interleaved stack tends to result in channels from a particular group being at the outermost (top and bottom) layers of the stack. In the core 3, channels 10 and 70 provide such outermost layers. In the FIG. 1 configuration, by passing hot fluid through the first group, hot fluid channels pass through these peripheral layers.

Figure 6:
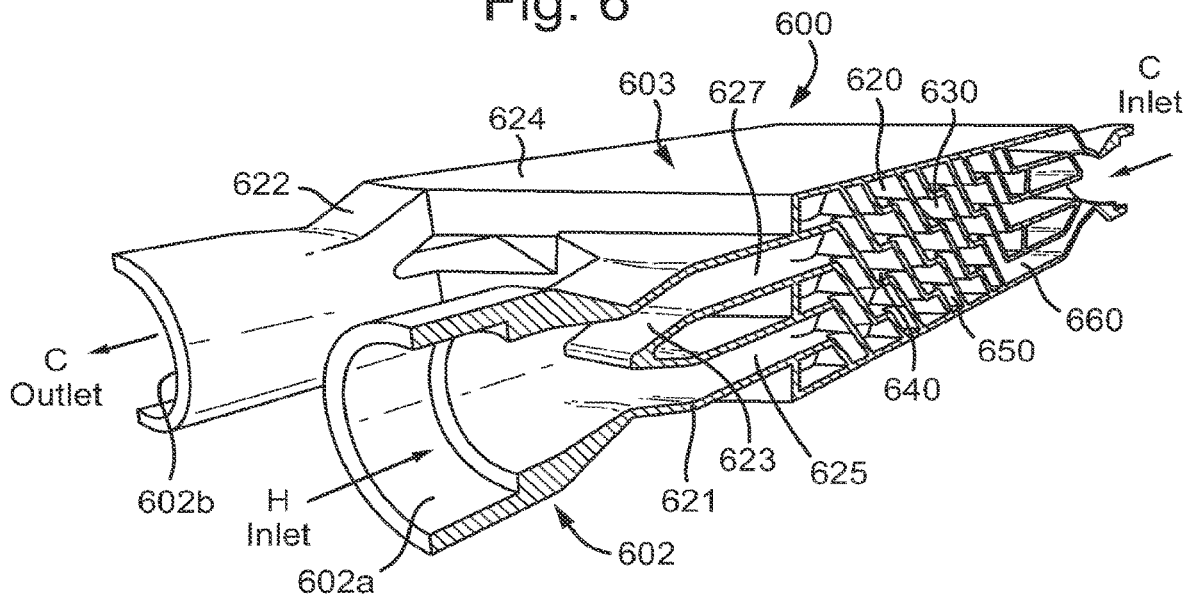
FIG. 6 shows a three-dimensional representation of a second heat exchanger.

In alternatively configured cores, such as shown in FIGS. 5 and 6, the cold fluid may be passed through a first group of channels providing the peripheral layers of the stack, whilst the hot fluid is passed through a second group of channels interleaved with the first group. Such alternative arrangements can tend to less heat being lost to the surroundings, tending to raise the efficiency of the exchanger.

In addition to the channels, the core 3 comprises a plurality of conduits (spur conduits) which split off their main channel and interconnect with other channels from the same group. (These interconnecting conduits 8 can be considered to be a spur off of a channel in so far as it offers an alternative flow path to the fluid, but does Is not associated with an occlusion or termination of their main channel).

As such, a plurality of first conduits 8 provides inter-channel connections between odd-numbered channels. As such a fluid can flow between the interconnected channels. Each conduit 8 extends through an even channel but does not fully occlude that even channel.

For example, a plurality of conduits 8 are provided, each of which interconnects the first channel 10 and the third channel 30, passing through the second channel 20.

Some conduits 8 are substantially perpendicular to the channels. Some conduits are inclined to the channels.

In the first example, the odd conduits extend only between neighbouring odd channels; however in alternative examples, some odd conduits could extend between other odd channel combinations. For example, an odd conduit could connect a first channel 10 and a fifth channel 50, passing through the second 20, third 30, and fourth 40 channels.

A plurality of second conduits 9 provides inter-channel connections between even-numbered channels. As such a fluid can flow between the interconnected channels. Each of the second conduits 9 extends through at least one odd channel but does not fully occlude it or them.

The first manifold 2 comprises, given the counter-flow configuration, an odd channel egress manifold collocated with an even channel ingress manifold. The odd channel egress manifold connects, by way of a branched chamber, the odd outlets from the core to a common odd outlet $C_{out}$. The even channel ingress manifold connects, by way of a branched chamber, the even inlets to the core to a common even inlet, $H_{in}$. As such, a first fluid can pass from the odd channels to the common odd outlet. As such a second fluid can pass from the common even inlet to the even channels.

The second manifold 4 comprises, in reciprocity with the first manifold 2, an even channel egress manifold collocated with an odd channel ingress manifold. The even channel egress manifold connects, by way of a branched chamber, the even outlets from the core to a common even outlet. The odd channel ingress manifold connects, by way of a branched chamber, the odd inlets to the core to a common odd inlet $C_{in}$. As such, a first fluid can pass from the even channels to the common even outlet $H_{out}$. As such a second fluid can be transported from the common odd inlet $C_{in}$ to the odd channels.

Figure 2:
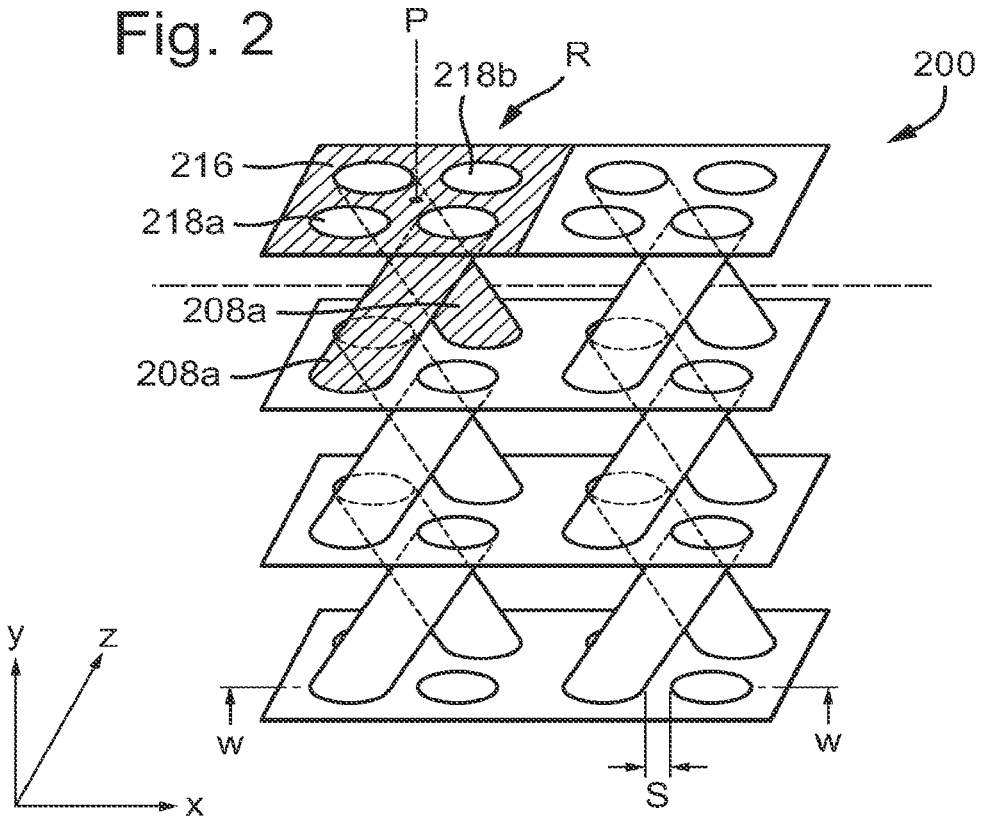
FIG. 2 shows a three-dimensional representation of a first example portion of a heat exchanger core.

With reference to FIG. 2, there is shown a three-dimensional portion 200 of a heat exchanger core which could be used in the heat exchanger 100. The portion 200 is shown in the context of three mutually orthogonal reference axes, x, y, and z. As shown on the page, the y-dimension corresponds to height (up/down), the x-dimension corresponds to width (fore/aft, or alternatively right/left) and the z-dimension corresponds to depth (near/far).

The portion 200 corresponds to a portion of the third, fourth and fifth channels of the core 3.

The portion 200 is comprised by a set of repeating units R (shown as the shaded components in the top left of FIG. 2).

A repeating unit R comprises a base plate section 216 which has a rectangular planar form, which is parallel with the zx plane.

Formed in the base plate section 216 is a pair of openings 218*a* and 218*b* and a pair of linear conduits 208*a*, 208*b*. The openings and conduits are arranged such that their footprints in the plate 216 define a rectangle, with conduit footprints positioned diagonally opposite on another.

The conduits 208*a* and *b* extend in or parallel to the yx plane out from the plate 216 and are inclined to the plate 216 by approximately 45 degrees. More particularly the near conduit 208*a* extends from a foremost and nearmost footprint in a backwards direction (−45 degrees), and the far conduit 208*b* extends from an aftwards and farmost footprint in a forwards direction (+45 degrees).

As such, given that the base plate 216 defines an axis P which extends perpendicularly through the centroid of the plate 216, the openings 218*a* 218*b* and the conduits 208*a* 280*b* are arranged such that they exhibit rotational symmetry, order 2, about the base plate axis P.

The extension of the conduits is such that the near conduit 208*a* meets the near opening of the plate 226 below, whilst the far conduit meets the far opening of the plate 226 below.

Whilst only a section 200 of a core 3 has been described, it will be appreciated that any size of core 3 could be populated with repeating units R by forming multiple repeating units in the x, y, and z directions. In effect this would form a number of continuous base plates interconnected by a plurality of conduit pairs.

With all conduits of the portion 200 extending parallel to the same plane, the yx plane, such cores would be suitable for co-flow and counter-flow arrangements.

Figure 3:
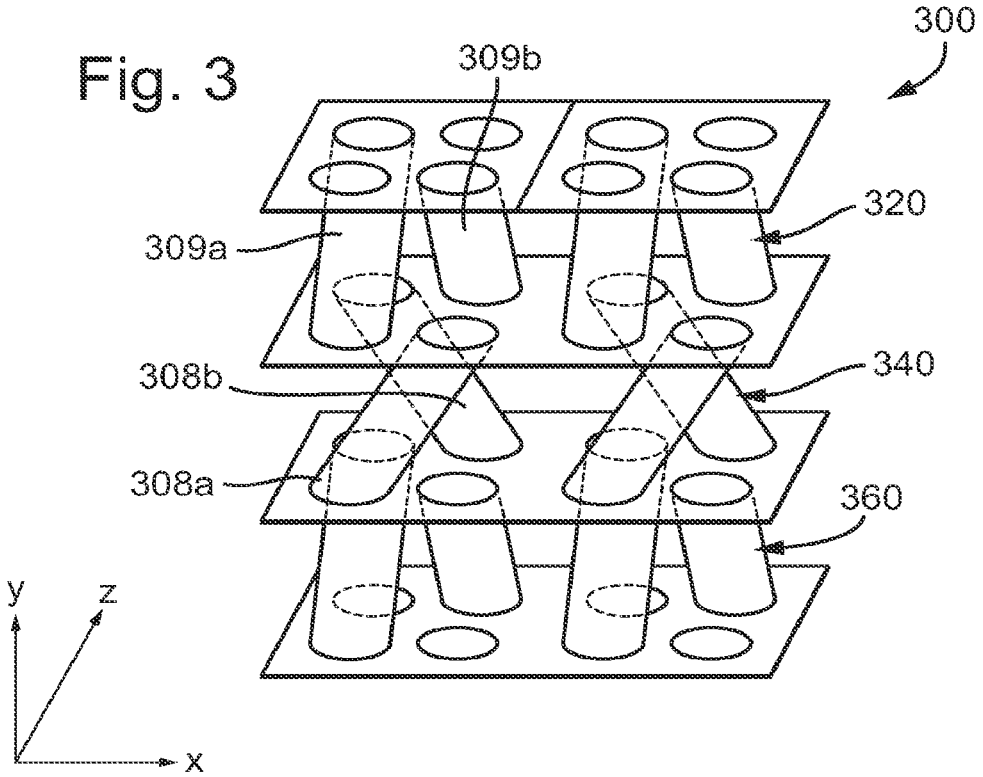
FIG. 3 shows a three-dimensional representation of a second example portion of a heat exchanger core.

With reference to FIG. 3, there is shown a portion 300 for a heat exchanger core which would be suitable for a cross-flow arrangement.

The portion 300 shown comprises three channels 320, 340 and 360 interleaved in that order. The channels 320 and 360 are for passing a first fluid, H, in the x-direction (that is to say from aft to fore) and the channel 340 is for transporting a second fluid, C, in the z-direction (i.e. from near to far).

Each of a plurality of conduits 308 extends between the H channels 320 and 360, and through the C channel 340, in or parallel to the yx plane. Thus the channels 320 and 360 are in fluid communication.

Each of a plurality of conduits 309 extends between the C channel 340 and the next upwards C channel, passing through the H channel 320, in or parallel to the yz plane.

The portion 300 for the heat exchanger core can be seen as a combination of the repeating unit R discussed in connection with portion 200 and FIG. 2, with a further repeating unit. As shown in FIG. 3, two R-type units are present in one layer, and these are sandwiched between further layers, each further layer having two further repeating units. As such the R-type layers alternate with further-type layers.

Each further repeating unit is the mirror image of the unit R, reflected in an yz plane, and rotated by 90 degrees, about its plate axis P.

Figure 4:
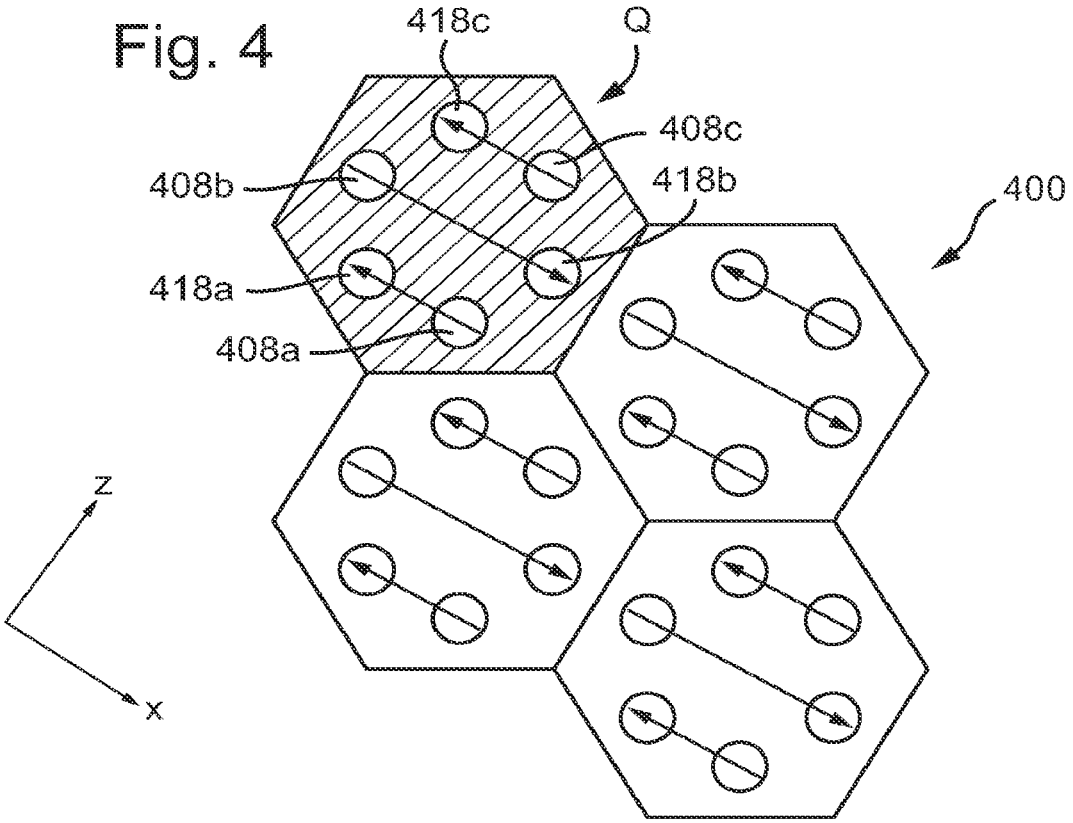
FIG. 4 shows a schematic layout of a fourth example portion of a heat exchanger core.

With reference to FIG. 4, there is a shown schematically a further example of a portion, indicated generally at 400, of a heat exchanger core.

The portion 400 is comprised from a number of repeating units Q, each of which, as with repeating units R, tessellates with other repeating units. The units Q comprise a hexagonal base plate 416, in which is provided six regularly spaced footprints, arranged symmetrical about the axis defined by the plate 416. Three of the footprints correspond with openings 418*a-c*, three of the footprints correspond with conduits 408*a-c* which extend upwardly from the base plate in the yx plane. Two of the conduits, the nearest 408*a* and farthest 408*c* extend aftwards. The other conduit, middle/aftmost conduit 408*b*, extends forwards.

FIG. 6 shows a monolithic multi-channel heat exchanger 600 where three first fluid channels 620, 640 and 660 are interleaved with 2 second fluid channels 630 and 650. A first integrated manifold 602 communicates with the channels at a first side of the exchanger 600. A second integrated manifold 604 communicates with the channels at a second side of the exchanger 600.

The first manifold 602 comprises a first common port 602*a* for working fluid H and a second common port 602*b* for coolant C.

The first common port 602*a* is generally cylindrical and communicates with a chamber leading to three onward branches (one of which 622 is visible) each of which meets a respective taper section (624) which tapers out to meet a respective channel (620).

The second common port 602*b* is generally cylindrical and communicates with a chamber leading to two onward branches 621, 623 each of which meets a respective taper section 625, 627 which tapers out to meet a respective channel 630, 650.

For illustrative purposes, heat exchanger 600 is shown in cut-away, at a point in the core equivalent to the cross section WW shown in FIG. 2.

In the heat exchanger 600, for a given plate, the separation between each opening and the outer diameter of the relevant neighbouring conduit is negligible. In other words and with respect to FIG. 2, the separation S is zero. Such a provision tends to promote smooth flow from the channel into the conduit.

For either the heat exchanger 100 or 600, in operation, a first, or cold fluid C, is put under pressure and thereby caused to flow into the common cold fluid inlet of first manifold, then through the first manifold, then into and through the even channels and then into the second manifold, and then out of the second manifold at the common cold outlet.

Whilst flowing through the first manifold, the cold fluid splits into separate flows, each one associated with a particular even channel. As the fluid flows through a given even channel, it may be further diverted by the conduits 9, which bleed off some of the fluid into neighbouring even channels. Meanwhile, some of the fluid flowing through neighbouring even channels will be bled off into the given even channel.

Whilst flowing within the given even channel, the fluid will flow around the odd conduits 8 which extend through the given channel.

An equivalent flow occurs as the second, or hot fluid, is introduced to heat exchanger at the second manifold, whereupon it flows into and through the odd channels, and into first manifold where it leaves the heat exchanger.

No mixing of the first and second fluids is permitted.

The base plates and conduits are formed from a thermally conductive material. Thus there is provided a surface area at the boundaries between hot and cold fluids which enable the transfer of thermal energy from the hot fluid to the cold fluid.

The inclination of the conduits 9, 8 promotes bleeding off and inter-channel fluid mixing. In particular, the conduits that extend from a given channel in the opposite general direction to the flow (e.g. at −45 degrees), will tend to bleed fluid into the given channel from neighbouring same-fluid channels. Further, conduits extending from a given channel in the same general direction to the flow (e.g. at +45 degrees) will tend to bleed fluid out of the given channel into neighbouring same-fluid channels.

The interconnecting conduits 8 and 9 are generally inclined at 45 degrees and as such are biased to promote the inter-channel flow. Such an angle can be achieved using an additive layer manufacturing process, providing a sufficiently robust structure without requiring supports or buttressing. In alternative examples, a range of angles may be suitable for this inclination. For example inclinations in the range of 30 to 60 degrees or 40 to 50 degrees may be suitable, with additional supporting structures provided as appropriate.

In other alternative examples of the heat exchanger, the conduits could extend perpendicularly from the base plate and thereby achieve or promote inter-channel fluid mixing; such an arrangement may lead to a greater pressure drop across the core as compared with the inclined conduits.

Alternatively, conduits could be fitted with a one-way valve to promote certain flow characteristics.

Each of the interconnecting conduits defines an inner cross section (bore) and outer cross section (outer wall), which will have the same form if the wall-thickness is constant.

The outer wall of an interconnecting conduit may have a number of different forms. For example the outer wall may be of a circular cross section as shown in FIGS. 2, 3, and 4 for example.

Figure 8A:
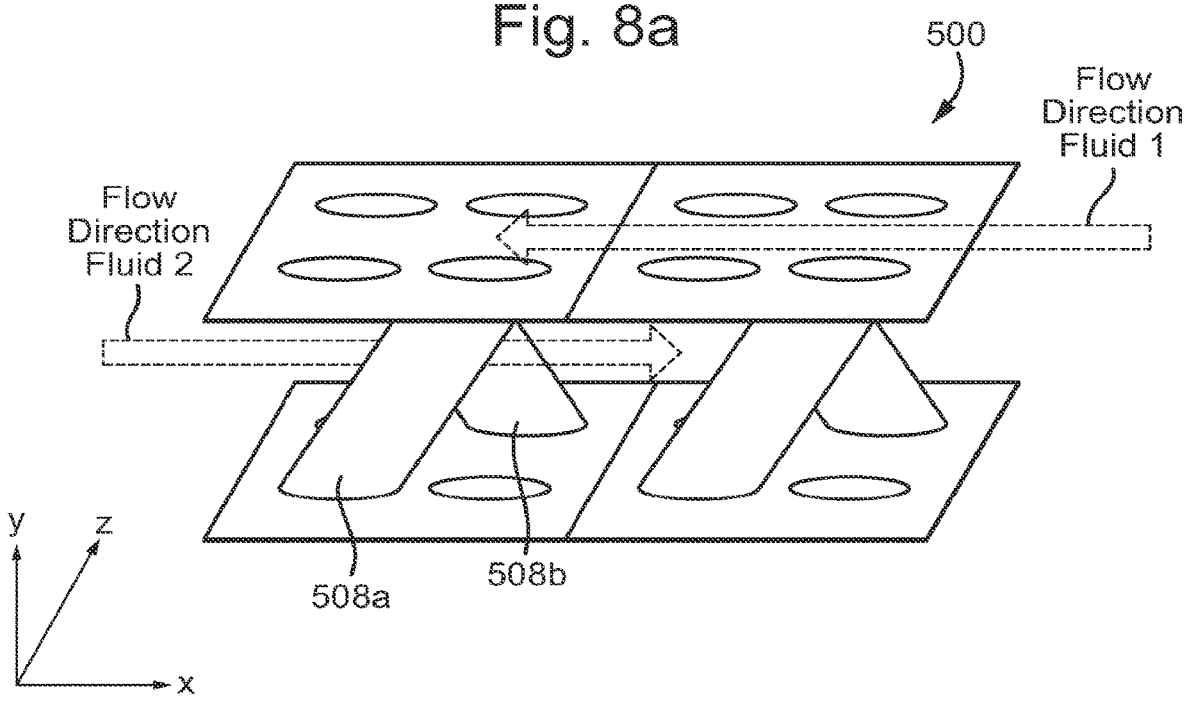
FIGS. 8*a* and 8*b* show an alternative configuration of the first example of the heat exchanger.
Figure 8B:
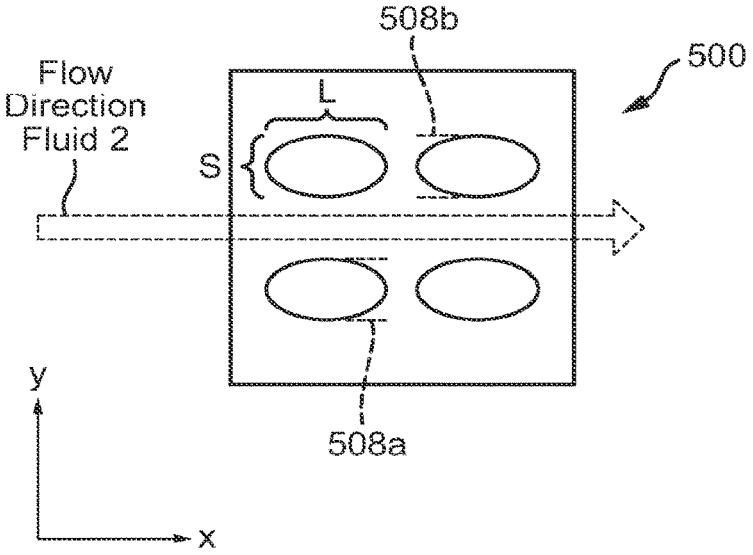

Alternatively the conduit may have an elongate cross-sectional form with a shorter aspect axis S and a longer aspect axis L as shown in the heat exchanger 500 of FIGS. 8*a* and 8*b*.

Elongate form outer walls applicable to the present heat exchangers would include elliptical, ovoid, rectangular, rhomboid, rhombus, trapezoid or kite cross-sections.

Elongate form outer walls applicable would include those with aspect ratios ranging from 4:1 to 1:1, but more preferably 2.5:1 to 1.5:1.

In certain embodiments, elongate form outer walls are aligned so that the longer aspect of their outer wall is aligned with the predetermined direction of the flow (or at least the expected direction of the flow). This is shown in FIG. 8*b* where the long axis of the ellipse (shown as a dot dash dot line) is parallel with the flow direction.

Where the conduits are inclined, the longer aspect of the outer wall can be aligned with the plane in which the conduit is inclined (referring to FIG. 8*b*, see how the long axis of the ellipse is parallel with the walls out the conduit 508*a* and 508*b*). Often the conduits will be configured to be inclined in alignment with the predetermined flow direction, and as such this arrangement tends to help guide flowing fluid into the conduit and thereby promote inter-channel mixing. Further, the alignment of incline and longer aspect of outer wall tends to provide a structure that is better arranged to facilitate additive layer manufacturing techniques, as it can better support an overhanging structure (thereby obviating at least to some degree the need for supporting structures such as buttresses).

Further, where the elongate bore is of the form that tapers (e.g. ellipsoidal, ovoid, rhomboid, rhombic, etc) there tends to be a beneficial flow characteristic because there is presented a smaller frontal area to the other fluid flow as it extends between the channels it connects. This tends to lead to a lower pressure drop in the other fluid channel.

For cross-flow heat exchanger examples, it may not be straightforward to collocate the first fluid ingress manifold and the second fluid egress manifold (and vice versa) at a single integrated manifold 2 (or 4). Thus in cross-flow configurations, there could be four separate manifolds.

The heat exchangers provided for can be formed from a heat-conducting material having the structural integrity to retain complex forms. Metals for example would be suitable.

The heat exchangers provided for can be manufactured using additive layer manufacturing techniques (also known as additive manufacturing, or 3D printing). For example, a selective laser melting (SLM) process may be used to form the heat exchanger. SLM uses a high power-density laser to melt and fuse metallic powders together.

Thus, in accord with these properties, the heat exchanger may be formed from any of a number of suitable materials which would be apparent to the skilled person, including but not limited to an Inconel alloy, titanium or an alloy thereof, aluminium or an alloy thereof, or a stainless steel.

Figure 7:
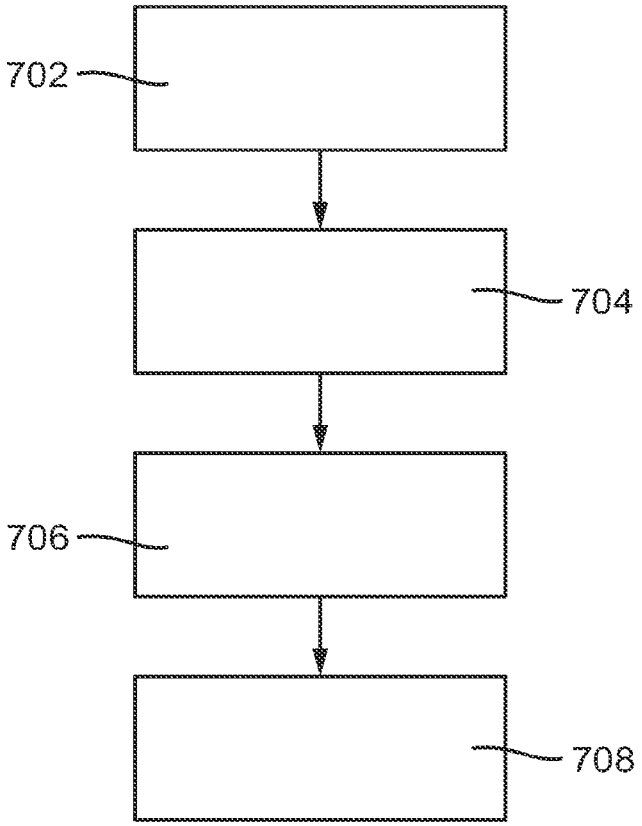
FIG. 7 shows a flow diagram for arranging a heat exchanger.

With reference to FIG. 7, a method of forming a heat exchanger structure is shown as involving a first step 702 of defining a repeating unit, a second step 704 of defining an operational characteristic set for a heat exchanger structure, a third step 706 of determining the parameters of the repeating units which satisfy the operational characteristic set, and at a fourth step 708, forming the structure according to the parameters.

At step 702, defining the repeating unit includes providing the definition of the repeating unit R having a set of variable parameters including but not limited to: base plate size, base plate thickness, base plate shape, conduit upward extension (i.e. channel height), opening/conduit bore, conduit wall thickness, conduit inclination, footprint location, and in-channel orientation (i.e. which plane the conduits align with for a channel, determining counter flow or co flow).

At step 704, the operational characteristic set may define a number of constraints including but not limited to: a desired thermal transfer rate, a working fluid combination (e.g. air and air, oil and fuel, air and glycol), a given space into which the exchanger should fit, a channel height, and an allowable pressure drop across the heat exchanger.

At step 706, the determination of the parameters of the unit R could be carried out, in light of the operational characteristics from step 704, using a number of fluid dynamic simulations of the heat exchanger. These simulations could be carried out iteratively, for example in combination with a genetic algorithm, to arrive at a solution. The output of such determinations would be a data file defining a suitable heat exchanger, the definition including the parameters for the unit R, and the repetition frequency of R along each of the three orthogonal axes (for example referring back to FIG. 6, it can be seen that there are four units along the fore to aft axis, and five along the bottom to top axis, with the near to far number being hidden from view).

At step 708, the heat exchanger could be formed by issuing the data file to an additive layer manufacturing station.

In certain examples a manifold, corresponding to the heat exchanger core, could be generated by the process. A data file defining such a manifold could thereby be issued to an additive manufacturing station, alongside the heat exchanger data file, to enable the entire heat exchanger to be formed.

In general, the examples given so far have been in the form of multi-layer heat exchangers. In other examples, the heat exchanger may comprise channels in the form of a tubular cluster. Within this cluster, a first group of tubes (odd tubes) would carry a first fluid, and a second group of tubes (even tubes) would carry a second fluid. A first set of conduits would provide interconnections between the odd tubes, with interconnecting conduits passing through an even tube. A second set of conduits would interconnect the even tubes, with interconnecting conduits passing through an odd tube. As a further alternative, such tubular clusters could comprise linear tubes arranged in parallel. Such tubular clusters could comprise nested spirals of tubes.

In general, the example cores given so far have been in the form of planar or substantially planar layers and channels, formed by planar base plates stacked in parallel. In alternative examples, the core may be provided by a plurality of curved channels which may be of a predetermined shape or curvature so as to be conformal with a further device. The further device could be a substantially cylindrical engine. Within such cores, channels could be substantially conformal with one another, so as to maintain an inter-plate separation.

All of the features disclosed in this specification (including any accompanying claims, abstract and drawings), and/or all of the steps of any method or process so disclosed, may be combined in any combination, except combinations where at least some of such features and/or steps are mutually exclusive.

Each feature disclosed in this specification (including any accompanying claims, abstract and drawings) may be replaced by alternative features serving the same, equivalent or similar purpose, unless expressly stated otherwise. Thus, unless expressly stated otherwise, each feature disclosed is one example only of a generic series of equivalent or similar features.

The invention is not restricted to the details of the foregoing embodiment(s). The invention extends to any novel one, or any novel combination, of the features disclosed in this specification (including any accompanying claims, abstract and drawings), or to any novel one, or any novel combination, of the steps of any method or process so disclosed.

The invention claimed is:

1. A heat exchanger comprising:
- a plurality of first fluid channels;
- a plurality of conduits for interconnecting the first fluid channels;
- a plurality of second fluid channels;
- a plurality of conduits for interconnecting the second fluid channels;
- wherein the heat exchanger is configured as a plurality of repeating units, each repeating unit comprising:
  - a base plate comprising a first opening, and a first conduit extending from the plate, the shape of the opening corresponding to the shape of the conduit; and
- wherein the base plate is repeated in a tessellating form.

2. The heat exchanger according to claim 1 wherein the plurality of repeating units are arranged as a matrix, where units repeat in a first and second mutually orthogonal direction, and each repeating unit is contiguous with neighbouring units in the plane defined by the first and second mutually orthogonal direction, such that base plates in the plane are coplanar.

3. The heat exchanger according to claim 1 wherein the units repeat in a third direction mutually orthogonal to a first and a second direction, where each repeating unit is contiguous with neighbouring units such that the conduit from a first neighbouring unit connects to the first opening and the conduit connects to an opening of a second neighbouring unit.

4. The heat exchanger according to claim 1, wherein at least one conduit of the plurality of conduits conduit is substantially straight and is substantially perpendicular to the base plate.

5. The heat exchanger according to claim 1, wherein at least one conduit of the plurality of conduits conduit is inclined to the base plate and terminates in a space perpendicularly above the opening.

6. The heat exchanger according to claim 1 wherein at least one conduit of the plurality of conduits conduit has an elongate cross-sectional form.

7. The heat exchanger according to claim 6 wherein the elongate cross-sectional form defines a shorter aspect S and a longer aspect L, wherein the longer aspect L is substantially aligned with a predetermined flow direction.

8. The heat exchanger according to claim 6 wherein the elongate cross-sectional form defines a shorter aspect S and a longer aspect L, wherein the longer aspect L is substantially aligned with the incline of the conduit.

9. The heat exchanger according to claim 1 wherein the base plate has a further opening and a further conduit.

10. The heat exchanger according to claim 9 wherein the opening, conduit, further opening and further conduit, has rotational symmetry substantially about an axis extending perpendicularly from the base plate.

11. The heat exchanger according to claim 1 wherein a bore of said conduits is tapered, presenting a smaller frontal area to an other fluid flow as it extends between channels it connects, whereby a pressure drop in the other fluid channel is lowered.

12. The heat exchanger according to claim 1 wherein at least one said conduit comprises a one-way valve, thereby promoting flow characteristics.

13. A method of forming a heat exchanger structure for a heat exchanger having a plurality of first fluid channels and a plurality of second fluid channels, the first fluid channels comprising a plurality of interconnecting conduits, the second fluid channels comprising a plurality of interconnecting conduits, the method comprising:

defining said plurality of first fluid channels;

defining said plurality of conduits for interconnecting the first fluid channels;

defining said plurality of second fluid channels;

defining said plurality of conduits for interconnecting the second fluid channels;

wherein the heat exchanger is configured as a plurality of repeating units, each repeating unit comprising:

a base plate comprising a first opening, and a first conduit extending from the plate, the shape of the opening corresponding to the shape of the conduit;

wherein the base plate is repeated in a tessellating form;

defining said repeating unit;

defining a space available for the heat exchanger structure;

determining how many repeating units would combine to occupy the space available; and forming a plurality of the repeating units and thereby forming the heat exchanger structure.

14. The method according to claim 13 wherein the repeating unit is predetermined as being in the form of a base plate comprising a first opening, and a first conduit extending from the plate, the shape of the opening corresponding to the shape of the conduit.

15. The method according to claim 13 wherein defining the repeating unit comprises determining a base plate depth, a conduit inner and outer diameter, and an extension height.

16. The method according to claim 13 comprising further forming:

a housing for the heat exchanger structure;

a first manifold comprising:

a first fluid ingress manifold comprising an input port which splits into a plurality of input branches, each branch corresponding with a first fluid channel;

a second fluid egress manifold comprising an outlet port which convenes a plurality of outlet branches, each branch corresponding with a second fluid channel;

a second manifold comprising:

a first fluid egress manifold comprising an outlet port which convenes a plurality of outlet branches, each branch corresponding with a first fluid channel;

a second fluid ingress manifold comprising an input port which splits into a plurality of input branches, each branch corresponding with a second fluid channel, to thereby form a heat exchanger.

17. The method according to claim 16 wherein the first and second manifolds are each formed as a monolithic structure, the inlet branches and outlet branches being in an interdigitated arrangement.

18. The method according to claim 16 wherein the heat exchanger structure, the housing and the manifolds are formed in a single additive layer manufacturing process.

19. A heat exchanger comprising:

a first channel, for communicating between a first channel inlet and a first channel outlet;

a second channel for communicating between a second channel inlet and a second channel outlet;

a third channel for communicating between a third channel inlet and a third channel outlet; and a fourth channel for communicating between a fourth channel inlet and a fourth channel outlet;

comprising, towards a first end:

a first fluid ingress manifold connecting the inlets of the first and third channels to a common first fluid inlet port, and a second fluid egress manifold connecting the outlets of the second and fourth channels to a common second fluid outlet port; and comprising, towards a second end:

a first fluid egress manifold connecting the outlets of the first and third channels to a common first fluid outlet port, and a second fluid ingress manifold connecting the inlets of the second and fourth channels to a common second fluid outlet port;

wherein said first, second, third, and fourth channels comprise tubes;

said tubes comprising a first group of odd tubes for said first fluid, and a second group of even tubes for said second fluid;

wherein a first set of first conduits provide interconnections between said odd tubes, with interconnecting conduits passing through an even tube; and a second set of second conduits provide interconnections between said even tubes, with interconnecting conduits passing through an odd tube;

wherein walls of each of said tubes defines a base plate;

said base plate comprising a first opening, and a first conduit extending from the plate, the shape of the opening corresponding to the shape of the conduit; and wherein the base plate is repeated in a tessellating form.

* * * * *